US008657899B2

(12) United States Patent
Joo et al.

(10) Patent No.: US 8,657,899 B2
(45) Date of Patent: Feb. 25, 2014

(54) DUST COLLECTOR COMPRISING A HANDLE UNIT AND INTENDED FOR A VACUUM CLEANER

(75) Inventors: Sung Tae Joo, Gwangju (KR); Joung Soo Park, Jeonju-si (KR); Heung Jun Park, Gwangju (KR); Min Ha Kim, Gwangju (KR); Dong Houn Yang, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 11 days.

(21) Appl. No.: 13/392,312

(22) PCT Filed: Jun. 21, 2010

(86) PCT No.: PCT/KR2010/004010

§ 371 (c)(1), (2), (4) Date: Feb. 24, 2012

(87) PCT Pub. No.: WO2011/025138

PCT Pub. Date: Mar. 3, 2011

(65) Prior Publication Data

US 2012/0144787 A1 Jun. 14, 2012

(30) Foreign Application Priority Data

Aug. 26, 2009 (KR) ..... 10-2009-0079417

(51) Int. Cl.
*B01D 50/00* (2006.01)

(52) U.S. Cl.
USPC ..... 55/337; 55/357; 55/428; 55/429; 55/430; 55/433; 55/343; 55/345; 55/DIG. 3; 15/343; 15/327.2

(58) Field of Classification Search
USPC ..... 55/337, 357, 428, 429, 430, 432, 433, 55/DIG. 3, 343, 345; 15/353, 327.2
See application file for complete search history.

(56) References Cited

U.S. PATENT DOCUMENTS 7,380,308 B2 6/2008 Oh et al.
7,555,808 B2 7/2009 Oh et al.
(Continued)

FOREIGN PATENT DOCUMENTS

JP 2006-296697 11/2006
KR 10-0555321 4/2005
(Continued)

OTHER PUBLICATIONS

International Search Report for PCT/KR2010/004010 mailed Feb. 10, 2011.

*Primary Examiner* — Bullock Insuk
*Assistant Examiner* — Dung H Bui
(74) *Attorney, Agent, or Firm* — Staas & Halsey LLP

(57) ABSTRACT

Disclosed is a dust collector provided with a dust-removing unit. The disclosed dust collector comprises: a first centrifugal separating tube defining a first centrifugal area for separating dust from air suctioned in through a first inlet; a first dust box for collecting dust separated in the first centrifugal area; a first detaching portion having a first exhaust pipe unit for exhausting the air from the first centrifugal separating tube and the first dust box to the outside; and a handle unit for maintaining the first centrifugal separating tube and the first dust box coupled together, or for releasing the coupling thereof.

9 Claims, 7 Drawing Sheets

(56) References Cited

U.S. PATENT DOCUMENTS

| | | | | |
|---|---|---|---|---|
| 2006/0101609 | A1 | 5/2006 | Oh et al. | |
| 2006/0101610 | A1 | 5/2006 | Oh et al. | |
| 2006/0101611 | A1 | 5/2006 | Oh et al. | |
| 2009/0178233 | A1 * | 7/2009 | Yoo | 15/350 |

FOREIGN PATENT DOCUMENTS

| | | |
|---|---|---|
| KR | 10-2006-0107628 | 10/2006 |
| KR | 10-0651295 | 11/2006 |
| KR | 10-2007-0113354 | 2/2011 |

* cited by examiner

DUST COLLECTOR COMPRISING A HANDLE UNIT AND INTENDED FOR A VACUUM CLEANER

CROSS REFERENCE TO RELATED APPLICATIONS

This is a U.S. National Phase Application under 35 U.S.C. §371 of International Patent Application No. PCT/KR2010/004010 filed Jun. 21, 2010, which claims the benefit of Korean Patent Application No. 10-2009-0079417, filed Aug. 26, 2009, all of which are hereby incorporated by reference.

TECHNICAL FIELD

Embodiments relate to a dust collector having a handle unit for use in a vacuum cleaner, in which the dust collector includes upper and lower units configured to be separable from each other and the handle unit contributes to easy coupling/separation between the upper and lower units as well as easy movement of the dust collector.

BACKGROUND ART

A vacuum cleaner is designed to separate dust via centrifugal separation. Such a vacuum cleaner may include a centrifugal separator to separate dust (or impurities) using centrifugal force and a dust collector including a dust box configured to store the separated dust.

The dust collector is usually mounted in the vacuum cleaner and must be separated and moved from the vacuum cleaner when it is necessary to discharge dust stored therein or to clean the dust collector. Thus, the dust collector includes a grip piece for movement. Moreover, the dust collector is configured such that upper and lower units thereof are separable from each other when discharging dust (impurities) stored therein or during cleaning thereof.

Accordingly, the dust collector must exhibit easy coupling/separation between the upper and lower units as well as easy movement or attachment/detachment of the dust collector with respect to the vacuum cleaner and also, must firmly keep the upper and lower units coupled to each other. In this case, a wet type dust collector filled with water to remove dust has a greater need to fix the upper and lower units.

For this reason, a conventional dust collector may include a locking unit, which may firmly keep a grip piece, a centrifugal separation assembly and a dust box coupled to one another and also, may easily perform separation of the aforementioned components.

Examples of the related art may include Korean Patent Registration No. 560332 (related art I), Swiss Patent Laid-Open Publication No. 688734 (related art II) and European Patent No. EP1062900 (related art III).

Related art I discloses a dust collector in which coupling between a cyclone unit (centrifugal separator) and a dust box 120 is released as a user pushes a button while gripping a transportation grip piece provided at the dust box. Thereafter, as the user moves a handle of the coupling/separating grip piece to a predetermined position and then, lifts the handle, the cyclone unit and the dust box may be separated from each other.

Related art II discloses a dust collector in which a close contact rod is pivotally secured to an end of a handle and a distal end of a lateral protrusion installed to a dust box. As the close contact rod performs crank action according to a position of the handle, a filter chamber may be separated from the dust box.

Related art III discloses a dust collector in which a cover is fixed to a tank via coupling between lifting means provided at the cover and a handle.

However, the above described related arts I to III do not disclose a function to fix the handle or the grip piece without a risk of rotation and therefore, have a problem in that the handle or the grip piece may be unnecessarily shaken in a locking released state, causing inconvenience in use.

In addition, due to the fact that the above described related arts I to III do not disclose a function of fixing the handle or the grip piece in a locking released state without a risk of rotation, there is a problem in that collected impurities or water may leak via unwanted opening of a centrifugal separation assembly, causing secondary contamination.

DISCLOSURE

Technical Problem

It is one aspect to provide a dust collector having a handle unit for use in a vacuum cleaner, in which the handle unit enables easy coupling/separation or movement of the dust collector including a first centrifugal separating tube and a first dust box which are provided as separable upper and lower units.

It is another aspect to provide a dust collector having a handle unit for use in a vacuum cleaner, in which the handle unit is locked to prevent unwanted coupling release between a first centrifugal separating tube and a first dust box which are provided as separable upper and lower units.

It is a further aspect to provide a dust collector having a handle unit for use in a vacuum cleaner, in which the handle unit serves to prevent unwanted opening of a centrifugal separation assembly in a locking released state thereof, thereby improving stability in use.

Technical Solution

In accordance with one aspect, a dust collector for a vacuum cleaner, the dust collector includes a first separation structure including a first centrifugal separating tube which defines a first centrifugal separating area to separate dust contained in air introduced through a first inlet, a first dust box to collect the dust separated in the first centrifugal separating area and a first exhaust pipe unit to discharge the air to the outside of the first centrifugal separating tube and the first dust box, and a handle unit to keep the first centrifugal separating tube coupled to the first dust box, or to release coupling between the first centrifugal separating tube and the first dust box.

The handle unit may include a handle coupling member formed at the first centrifugal separating tube, and a handle including a rotating coupling member rotatably coupled to the handle coupling member, the handle serving to fix the first centrifugal separating tube coupled to the first dust box or release the fixed first centrifugal separating tube according to a rotating direction thereof.

The handle may further include a fixing piece formed at a lower end thereof, and a latch piece formed at a lateral surface of the first dust box so as to be coupled to the fixing piece, thereby keeping the first centrifugal separating tube coupled to the first dust box.

The rotating coupling member and the handle coupling member may be configured to stop rotation of the handle at a position where the handle fixes the first centrifugal separating tube and the first dust box coupled to each other, or at a position where the handle releases the fixed first centrifugal separating tube and first dust box.

The rotating coupling member may include first to third fixing protrusions spaced apart from one another along a circle having a predetermined radius from the center thereof so as to define a first fixing recess and a second fixing recess therebetween, the handle coupling member may include a fixing protrusion guide groove formed on a circle having a radius, corresponding to that of the circle on which the first to third fixing protrusions are formed, from the center thereof and an elastic member seating recess indented inside an accurate inner edge of the fixing protrusion guide groove, an elastic member being inserted into the elastic member seating recess such that a fixing bump thereof protrudes into the fixing protrusion guide groove, and the rotating coupling member and the handle coupling member may be coupled to each other to allow the first to third fixing protrusions to be rotatably inserted into the fixing protrusion guide groove, and when the handle is rotated, the fixing bump is inserted into the first fixing recess or the second fixing recess so as to stop rotation of the handle.

The rotating coupling member may further include a guide protrusion formed on the circle on which the first to third fixing protrusions are formed, and the handle coupling member may further include a guide protrusion groove formed on the circle on which the fixing protrusion guide groove is formed, such that the guide protrusion is inserted to be rotatable within a predetermined angular range.

The handle unit may further include a holder configured to be coupled to the handle when the handle is located at a position to fix the first centrifugal separating tube and the first dust box coupled to each other, thereby locking the handle so as not to be rotated.

The holder may include a grip piece fixing member rotatably coupled to an upper surface of the first centrifugal separating tube, the grip piece fixing member being coupled to or separated from the handle to selectively prevent rotation of the handle, and an elastic rib to provide elastic force required to return the grip piece fixing member to an original position thereof when the grip piece fixing member is coupled to the handle.

The holder may further include an elastic rib support piece protruding from the upper surface of the first centrifugal separating tube and configured to come into close contact with the elastic rib so as to accumulate the elastic force in the elastic rib.

The dust collector may be divided into a centrifugal separation assembly and a dust box unit, which are separably coupled to each other, the centrifugal separation assembly may include the first centrifugal separating tube and at least one second centrifugal separating tube, which respectively define a first centrifugal separating area and a second centrifugal separating area and are integrally formed with each other so as to communicate with each other through a second flow path, the top of the first separation structure provided with the first exhaust pipe unit and a second inlet tube unit being respectively coupled to the centrifugal separation assembly, and the dust box unit may include the first dust box and at least one second dust box, which respectively define a first wet type dust collecting area and a second wet type dust collecting area to collect dust separated in the first centrifugal separating area and the second centrifugal separating area using water and are integrally formed with each other, the second centrifugal separating tube and the second dust box defining a second centrifugal separation structure, and the dust box unit being coupled to bottoms of the first separation structure and the second centrifugal separation structure.

Advantageous Effects

In a dust collector including a first centrifugal separating tube and a first dust box which are separable from each other, with provision of a handle unit, it may be possible to ensure easy coupling/separation between the first centrifugal separating tube and the first dust box as well as easy movement of the dust collector, resulting in improved convenience in use.

Further, when the handle unit is rotated to a coupling fixing position or a fixing release position in a state in which the first centrifugal separating tube and the first dust box are coupled to each other, it may be possible to stop rotation of the handle unit at the fixing position or the fixing release position, which provides easy implementation of a fixing or fixing release operation of the first centrifugal separating tube and the first dust box using the handle unit, resulting in further improved convenience in use.

Furthermore, during the fixing or fixing release operation of the first centrifugal separating tube and the first dust box using the handle unit, an elastic member is used to allow the handle unit to be automatically rotated to the fixing or fixing release position and thereafter, to stop rotation, resulting in further improved convenience in use.

In the dust collector including upper and lower units coupled to each other, with provision of a locking function to prevent unwanted separation of the upper and lower units, it may be possible to prevent unwanted leakage of impurities collected in the dust collector.

Additionally, preventing unwanted leakage of impurities collected in the dust collector may provide improved sanitary use of the dust collector.

BEST MODE

Hereinafter, a dust collector 1 having a handle unit for use in a vacuum cleaner according to an embodiment will be described with reference to the drawings.

The present embodiment is described under the assumption that the dust collector 1 is a wet type dust collector.

Figure 1:
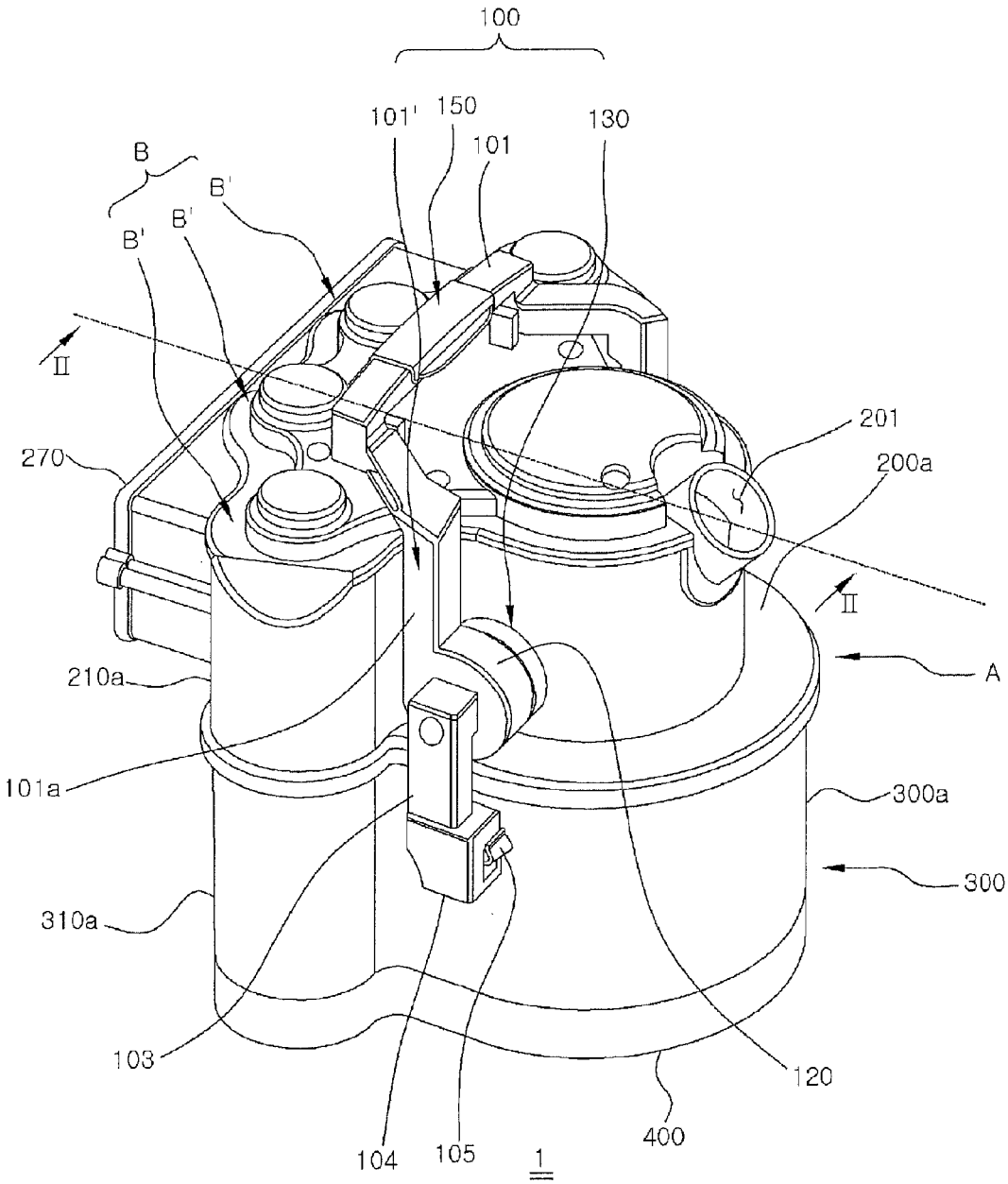
FIG. 1 is a perspective view of a dust collector 1 according to an embodiment.
Figure 2:
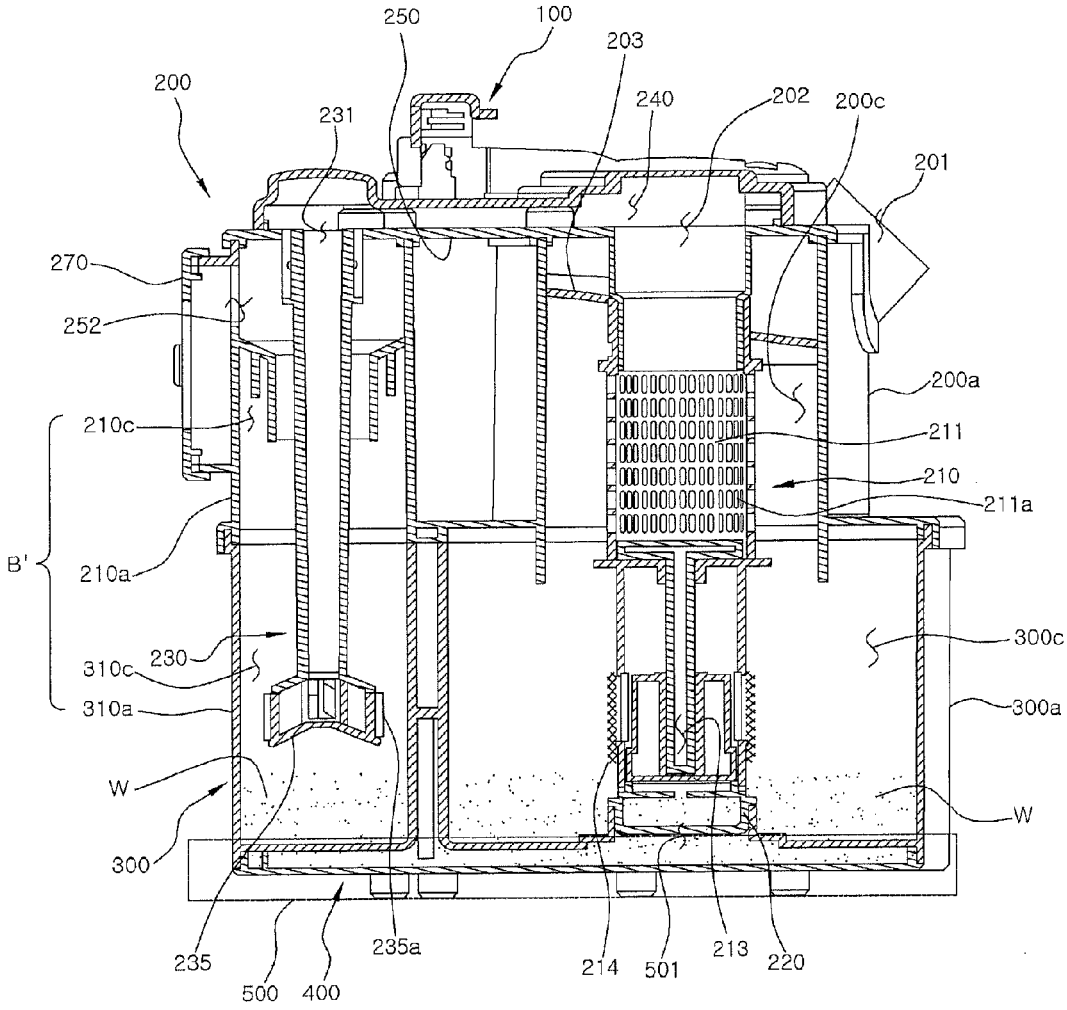
FIG. 2 is a sectional view of the dust collector 1 taken along the line II-II of FIG. 1.

FIG. 1 is a perspective view of the dust collector 1 according to the embodiment, and FIG. 2 is a sectional view of the dust collector 1 taken along the line II-II of FIG. 1.

Referring to FIGS. 1 and 2, the dust collector 1 includes a handle unit 100, a centrifugal separation assembly 200 and a dust box unit 300.

The handle unit 100 includes a handle 101', a handle coupling member 130 formed at the centrifugal separation assembly 200, and a holder 150.

The handle 101' includes a grip piece 101, grip piece support rods 101*a*, rotating coupling members 120, fixing levers 103, fixing pieces 104 and latch pieces 105 formed at the centrifugal separation assembly 200.

The grip piece 101 is shaped to be easily gripped. The grip piece support rods 101*a* respectively extend downward from opposite ends of the grip piece 101.

The rotating coupling member 120 and the handle coupling member 130 are configured to rotatably connect the grip piece support rods 101*a* to lateral surfaces of the centrifugal separation assembly 200 respectively. Configurations and functions of these components will be described in more detail in the following description with reference to FIGS. 4 to 6.

The fixing levers 103 extend downward from the respective rotating coupling members 120, so as to rotate along with the rotating coupling members 120. The fixing pieces 104 are respectively formed at lower ends of the fixing levers 103. The fixing pieces 104 perform a locking function to prevent the centrifugal separation assembly 200 from being separated from the dust box unit 300.

The latch pieces 105 are provided on an outer surface of a first centrifugal separating tube 200*a* at positions facing the respective fixing pieces 104. Accordingly, when the centrifugal separation assembly 200 and the dust box unit 300 are positioned so as to be locked with each other, the latch pieces 105 may respectively be coupled to the fixing pieces 104. In this case, the fixing piece 104 and the latch piece 105 may be caught by each other in an interference fit manner, a hook fastening manner, or the like.

The handle 101', as described above, may be coupled to the centrifugal separation assembly 200 so as to move the centrifugal separation assembly 200, or may serve to fixedly mount or separate the centrifugal separation assembly 200 to or from the dust box unit 300. Specifically, the handle 101' may be rotated about the centrifugal separation assembly 200 until the fixing piece 104 and the latch piece 105 are coupled to each other so as to fix the centrifugal separation assembly 200 to the dust box unit 300, or may be rotated to release coupling between the fixing piece 104 and the latch piece 105.

The holder 150 is configured so as to be coupled to the grip piece 101 at a position where the fixing piece 104 and the latch piece 105 are coupled to each other after the centrifugal separation assembly 200 is mounted to the dust box unit 300. Thereby, the holder 150 performs a locking function to prevent rotation of the handle 101'.

Among the above described configuration of the handle unit 100, configurations and functions of the rotating coupling member 120, the handle coupling member 130 and the holder 150, which perform rotation stop, fixing and locking functions of the handle 101' will be described hereinafter with reference to FIGS. 3 to 6.

Figure 3:
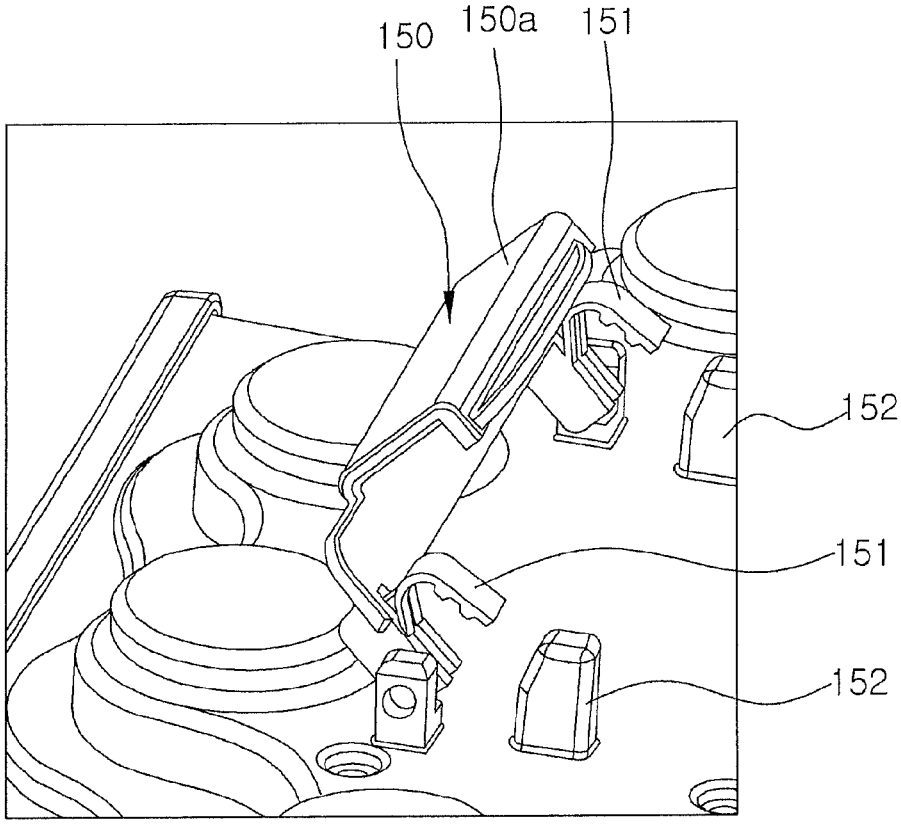
FIG. 3 is a perspective view of a holder 150 of FIG. 1.

FIG. 3 is a perspective view of the holder 150 of FIG. 1.

As illustrated in FIG. 3, the holder 150 includes a grip piece fixing member 150*a*, elastic ribs 151 and elastic rib support pieces 152.

The grip piece fixing member 150*a* takes the form of a bent plate suitable to be snap fitted to an upper surface of the grip piece 101. The grip piece fixing member 150*a* is rotatably installed to an upper surface of the centrifugal separation assembly 200, so as to be rotatable about one edge thereof.

The elastic ribs 151 have a downwardly open inverted 'U'-shaped form and are provided at a lower surface of the grip piece fixing member 150*a*.

The elastic rib support pieces 152 protrude from the upper surface of the centrifugal separation assembly 200. When the grip piece fixing member 150*a* is fitted to the grip piece 101, each elastic rib support piece 152 acts to apply pressure to the elastic rib 151 so that both ends of the elastic rib 151 defining an opening come into close contact with each other, thereby allowing elastic restoration force to be accumulated in the elastic rib 151.

Figure 4:
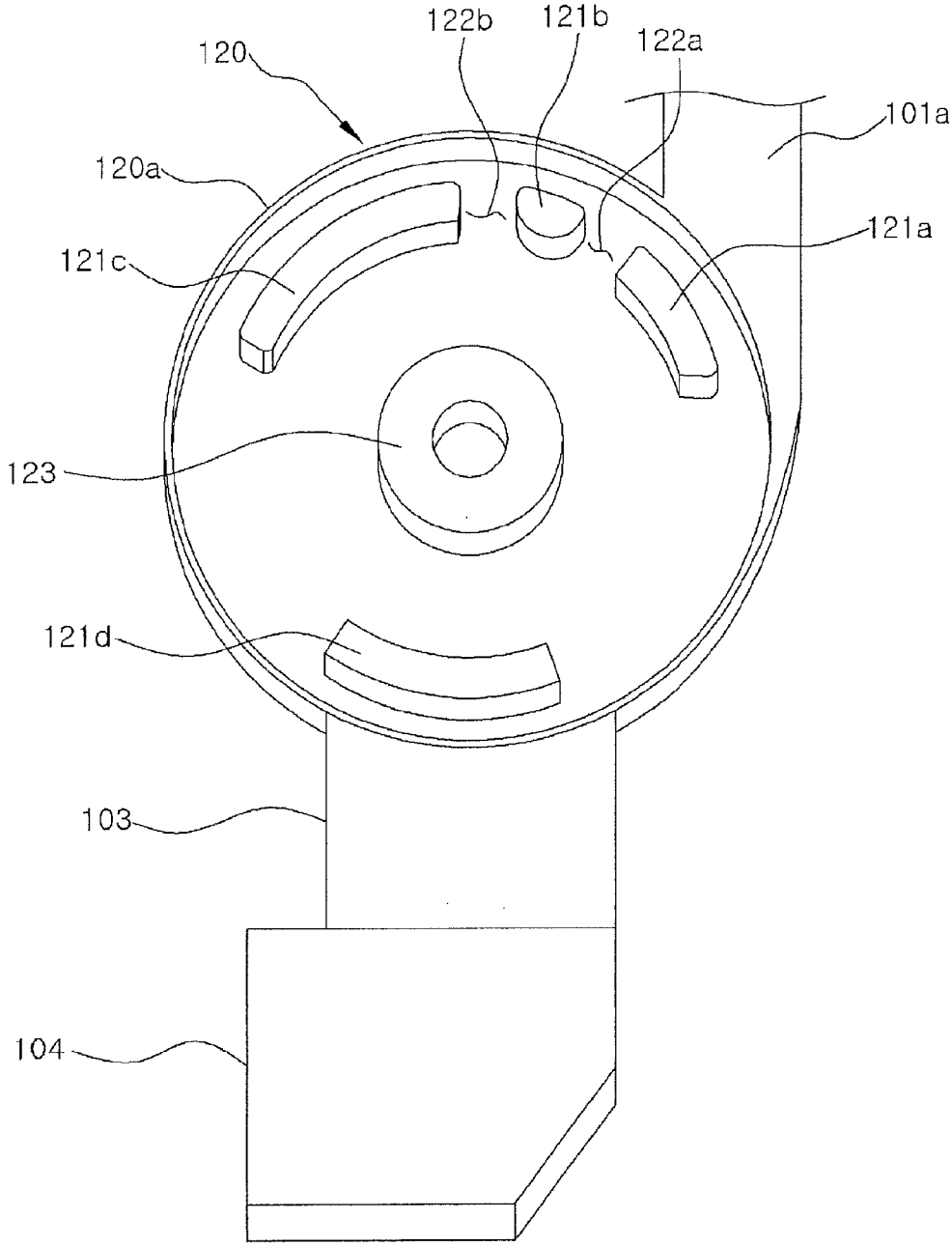
FIG. 4 is a rear perspective view of a rotating coupling member 120 of FIG. 1.
Figure 5:
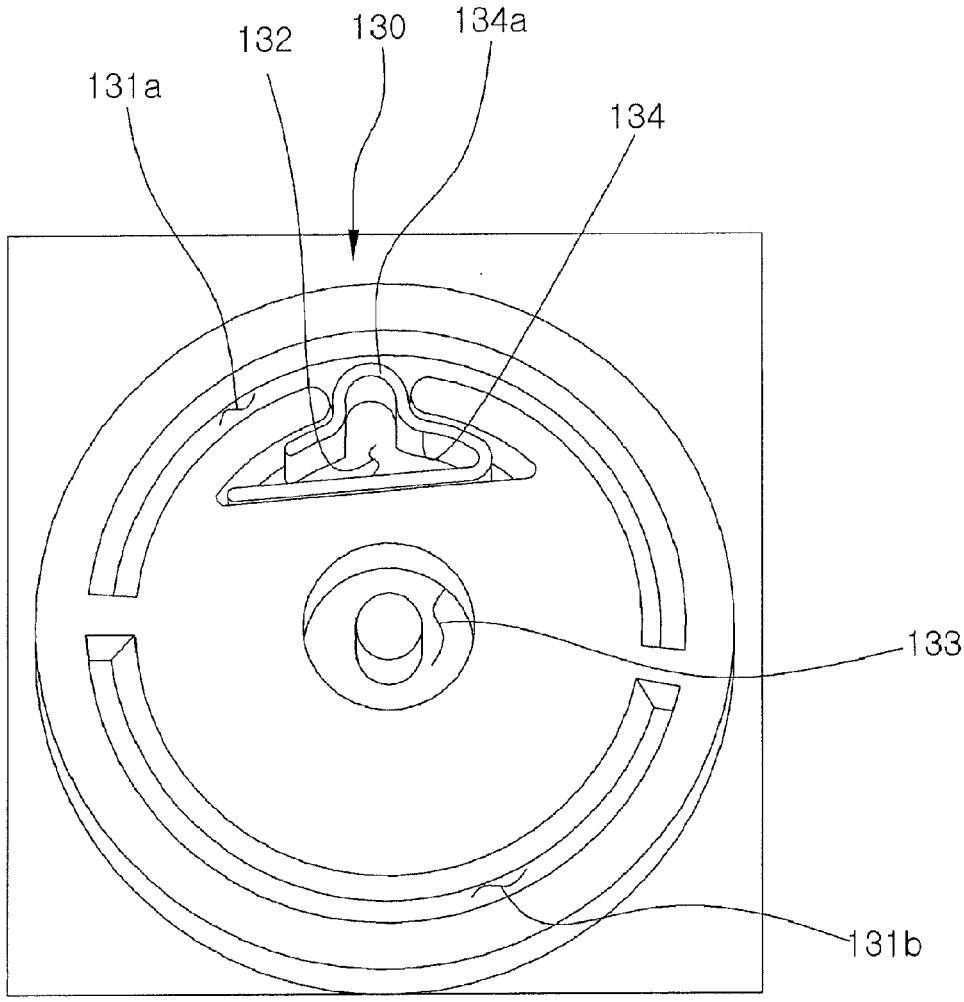
FIG. 5 is a front perspective view of a handle coupling member 130 of FIG. 1.
Figure 6:
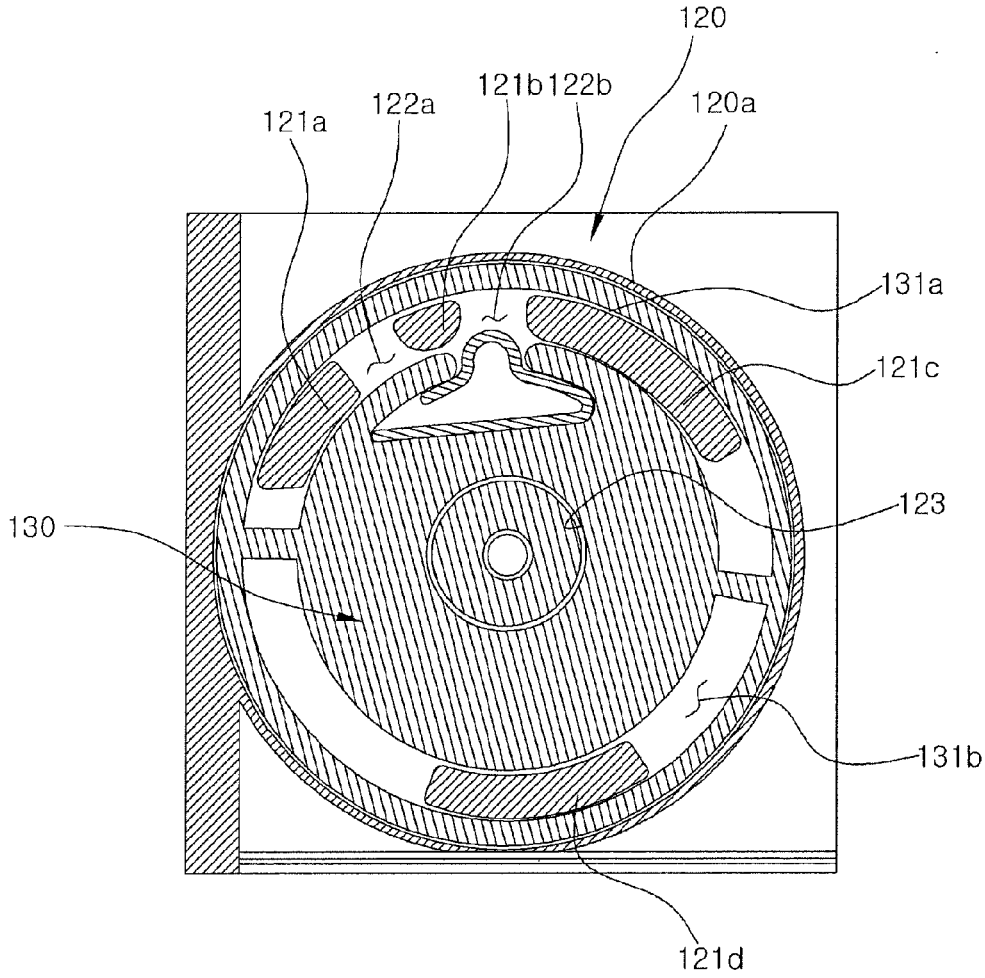
FIG. 6 is a sectional view illustrating a state in which the rotating coupling member 120 of FIG. 4 and the handle coupling member 130 of FIG. 5 are coupled to with each other.

FIG. 4 is a rear perspective view of the rotating coupling member 120 of FIG. 1, FIG. 5 is a front perspective view of the handle coupling member 130 of FIG. 1, and FIG. 6 is a sectional view illustrating a state in which the rotating coupling member 120 of FIG. 4 and the handle coupling member 130 of FIG. 5 are coupled to each other.

The rotating coupling member 120 and the handle coupling member 130 are configured to assist the handle 101' in stopping to rotate about the rotating coupling member 120 at a position where the handle 101' fixes the centrifugal separation assembly 200 coupled to the dust box unit 300 and at a position where the centrifugal separation assembly 200 is released from the dust box unit 300.

To this end, the rotating coupling member 120, as illustrated in FIG. 4, takes the form of a disc, which is coupled to a lower end of the grip piece support rod 101*a* and has an outer circumferential rib 120*a* protruding from the entire outer circumference thereof. A rotating shaft 123 protrudes from the center of a rear surface of the rotating coupling member 120 so as to be rotatably fitted into the handle coupling member 130. First to third fixing protrusions 121*a*, 121*b* and 121*c* are arranged on an imaginary circle having a predetermined radius from the rotating shaft 123 such that a first fixing recess 122*a* and a second fixing recess 122*b* are defined between the first to third fixing protrusions 121*a*, 121*b* and 121*c*. As will be described hereinafter, a fixing bump 134*a* of a leaf spring 134 (i.e. an elastic member) installed to the handle coupling member 130 is inserted into any one of the first fixing recess 122*a* and the second fixing recess 122*b*, so as to stop rotation of the grip piece support rod 101*a*. Additionally, a guide protrusion 121*a* is formed on the same circle as that, on which the first to third raised fixing protrusions 121*a*, 121*b* and 121*c* are formed, at an opposite position of the first to third raised fixing protrusions 121*a*, 121*b* and 121*c*. The guide protrusion 121*a* serves not only to cause rotation of the rotating coupling member 120, but also to support the rotating coupling member 120.

The handle coupling member 130, as illustrated in FIG. 5, protrudes from the outer surface of the centrifugal separation assembly 200. The handle coupling member 130 is provided at the center of an inner surface thereof with a rotating shaft coupling recess 133, into which the rotating shaft 123 is rotatably fitted. A leaf spring seating recess 132 (i.e. an elastic member seating recess) is additionally formed at a region adjacent to an inner circumference defining the rotating shaft coupling recess 133, such that the leaf spring 134, from which the fixing bump 134*a* protrudes, is seated in the leaf spring seating recess 132.

A fixing protrusion guide groove 131*a* and a guide protrusion groove 131*b*, which have an arcuate shape, are arranged on an imaginary circular line having the same radius from the rotating shaft coupling recess 133 as that from the rotating shaft 123 at positions opposite to the first to third fixing protrusions 121*a*, 121*b* and 121*c* and the guide protrusion 121*d*, such that the first to third fixing protrusions 121*a*, 121*b* and 121*c* are inserted into the fixing protrusion guide groove 131*a* so as to be rotatable within a predetermined angular range and the guide protrusion 121*d* is inserted into the guide protrusion groove 131*b* so as to be rotatable within a predetermined angular range. In this case, the leaf spring seating recess 132 is located at a part of an arcuate inner edge of the fixing protrusion guide groove 131*a* so as to communicate with the fixing protrusion guide groove 131*a*.

In the case of the rotating coupling member 120 and the handle coupling member 130 having the above described configurations, as illustrated in FIG. 6, the rotating shaft 123, the first to third fixing protrusions 121*a*, 121*b* and 121*c* and the guide protrusion 121*d* of the rotating coupling member 120 are rotatably inserted into the rotating shaft coupling recess 133, the fixing protrusion guide groove 131*a* and the guide protrusion groove 131*b* of the handle coupling member 130, respectively.

The fixing bump 134*a* is inserted into any one of the first fixing recess 122*a* and the second fixing recess 122*b* according to a rotating direction of the handle 101', thereby acting to stop rotation of the handle 101'. In this way, it may be possible to prevent unwanted rotation as well as excessive rotation of the handle 101'.

Hereinafter, functions of the rotating coupling member 120 and the handle coupling member 130 to prevent excessive rotation of the handle 101' and to stop rotation of the handle 101' in a locked state and in a locking released state will be described in more detail.

During rotation of the handle 101', the fixing bump 134*a* may be selectively inserted into the first fixing recess 122*a* or the second fixing recess 122*b* as illustrated in FIG. 6 thereby stopping rotation of the handle 101'.

Specifically, when the grip piece 101 is rotated counterclockwise in order to fix the centrifugal separation assembly 200 coupled to the dust box unit 300, the fixing bump 134*a* is inserted into the first fixing recess 122*a*, thereby stopping rotation of the handle unit 100.

Differently from the above description, when the grip piece 101 is rotated clockwise to separate the centrifugal separation assembly 200 from the dust box unit 300, the fixing bump 134*a* is separated from the fixing recess 122*a* and thereafter, is inserted into the second fixing recess 122*b*, thereby stopping rotation of the handle 101'.

With the above described operation, the rotating coupling member 120 and the handle coupling member 130 may function not only to prevent excessive rotation of the handle 101', but also to stop rotation of the handle 101' in a locked state as well as in a locking released state.

The centrifugal separation assembly (200, see FIG. 2) includes a first inlet 201, an exhaust chamber 270, a partition 250, a first centrifugal separating tube 200*a*, a first exhaust pipe unit 210, a plurality of second centrifugal separating tubes 210*a* and a plurality of second inlet tube units 230 which communicate with the exhaust chamber 270. Here, the partition 250 divides the interior of the centrifugal separation assembly into an upper region defining a second flow path 240 and a lower region defining a first centrifugal separating area 200*c* and a plurality of second centrifugal separating areas 210*c*.

The first inlet 201 is located at a lateral surface of the centrifugal separation assembly 200, to allow outside air directed from a brush assembly (not shown) of the vacuum cleaner to be introduced into the first centrifugal separating area 200*c*.

The exhaust chamber 270 is located at a lateral surface of the centrifugal separation assembly 200 where second exhaust holes 252 for discharging air having passed through the second centrifugal separating tube 210*a* are formed, such that all the second exhaust holes 252 are located in the area of the exhaust chamber 270. With the above described configuration, the exhaust chamber 270 functions to collect the air discharged from the second exhaust holes 252 and discharge the air to a fan motor unit (not shown) of the vacuum cleaner (not shown).

The partition 250 is provided in the bottom thereof with a first exhaust hole 202 communicating with the first exhaust pipe unit 210 and a plurality of second inlets 231 communicating with the plurality of second inlet tube units 230. The partition 250 is horizontally installed in the upper region of the centrifugal separation assembly 200 so as to divide the interior of the centrifugal separation assembly 200 into an upper region including the second flow path 240 and a lower region including the first centrifugal separating area 200*c* and the plurality of second centrifugal separating areas 210*c*. The second flow path 240 defined by the partition 250 guides the air discharged from the first exhaust hole 202 into the plurality of second centrifugal separating areas 210*c* through the plurality of second inlets 231 and the second inlet tube unit 230.

The first centrifugal separating tube 200*a* is a tube to define the first centrifugal separating area 200*c* in which heavy and bulky dust is separated from outside air introduced through the first inlet 201. The first centrifugal separating tube 200*a* may have various vertical cross sections including a quadrangular shape, a trapezoidal shape and an inverted trapezoidal shape. The first centrifugal separating tube 200*a* having the above described configuration is coupled to a lower surface of the partition 250 such that an upper end of the first centrifugal separating tube 200*a* communicates with the first exhaust hole 202.

The first exhaust pipe unit 210 is a cylindrical tube, which is provided with a guide 203, a grill 211 having exhaust holes 211*a*, and a sealing member 220. As introduced air swirls in the first exhaust pipe unit 210, dust is separated from the air. The resulting air, from which the dust has been removed, is discharged through the grill 211. The sealing member 220 is fitted into a water distributing opening 501 of a water distributing channel 500 and serves to isolate the water distributing channel 500 from a first wet type dust collecting area 300*c*.

The plurality of second centrifugal separating tubes 210*a* defines the second centrifugal separating area 210*c* therein. Once the air discharged from the first exhaust pipe unit 210 has been introduced into the second centrifugal separating tubes 210*a* through the second inlet tube unit 230 communicating with the second inlet 231, the second centrifugal separating tubes 210*a* separate fine dust contained in the air and discharges the resulting air to the exhaust chamber 270 through the second exhaust hole 252 perforated in an upper position of the lateral surface of the centrifugal separation assembly 200. The plurality of second centrifugal separating tubes 210*a* is arranged in parallel at the lateral surface of the first centrifugal separating tube 200*a* and is integrally formed with each other so as to communicate with each other through the second flow path 240.

An impeller 235 is provided at a lower end region of the plurality of second inlet tube units 230. The impeller 235 includes a plurality of through-holes and an impeller rib 235*a*, the impeller rib 235*a* being bent at a predetermined angle. The impeller 235 causes the air to be discharged while swirling about the second inlet tube unit 230. Thereby, the impeller 235 causes the air in the second centrifugal separating area 210*c* and water W in a second wet type dust collecting area 310*c* to swirl.

The dust box unit (300, see FIG. 2) includes a first dust box 300*a*, a plurality of second dust boxes 310*a*, and a lower cover 400 in which the water distributing channel 500 configured to communicate bottoms of the first dust box 300*a* and the second dust boxes 310*a* with each other is defined.

The first dust box 300*a* defines the first wet type dust collecting area 300*c* in which the water W swirls to collect dust. The first dust box 300*a* may have various vertical cross sections including a quadrangular shape, a trapezoidal shape and an inverted trapezoidal shape.

The second dust boxes 310*a* define the second wet type dust collecting area 310*c* in which the water W swirls to collect dust. The second dust boxes 310*a* defining the second wet type dust collecting area 310*c* are arranged in parallel along the lateral surface of the first dust box 300*a* at positions facing bottoms of the respective second centrifugal separating tubes 210*a*.

The first wet type dust collecting area 300*c* and the plurality of second wet type dust collecting areas 310*c* are configured to communicate at bottoms thereof with each other through the water distributing channel 500 such that both the first and second wet type dust collecting areas 300*c* and 310*c* are filled with the water W at the same time. A configuration of the water distributing channel 500 is disclosed in detail in Korean Patent Application No. 2009-0043736 filed by the application of the disclosure and thus, a detailed description thereof will be omitted herein.

Figure 7:
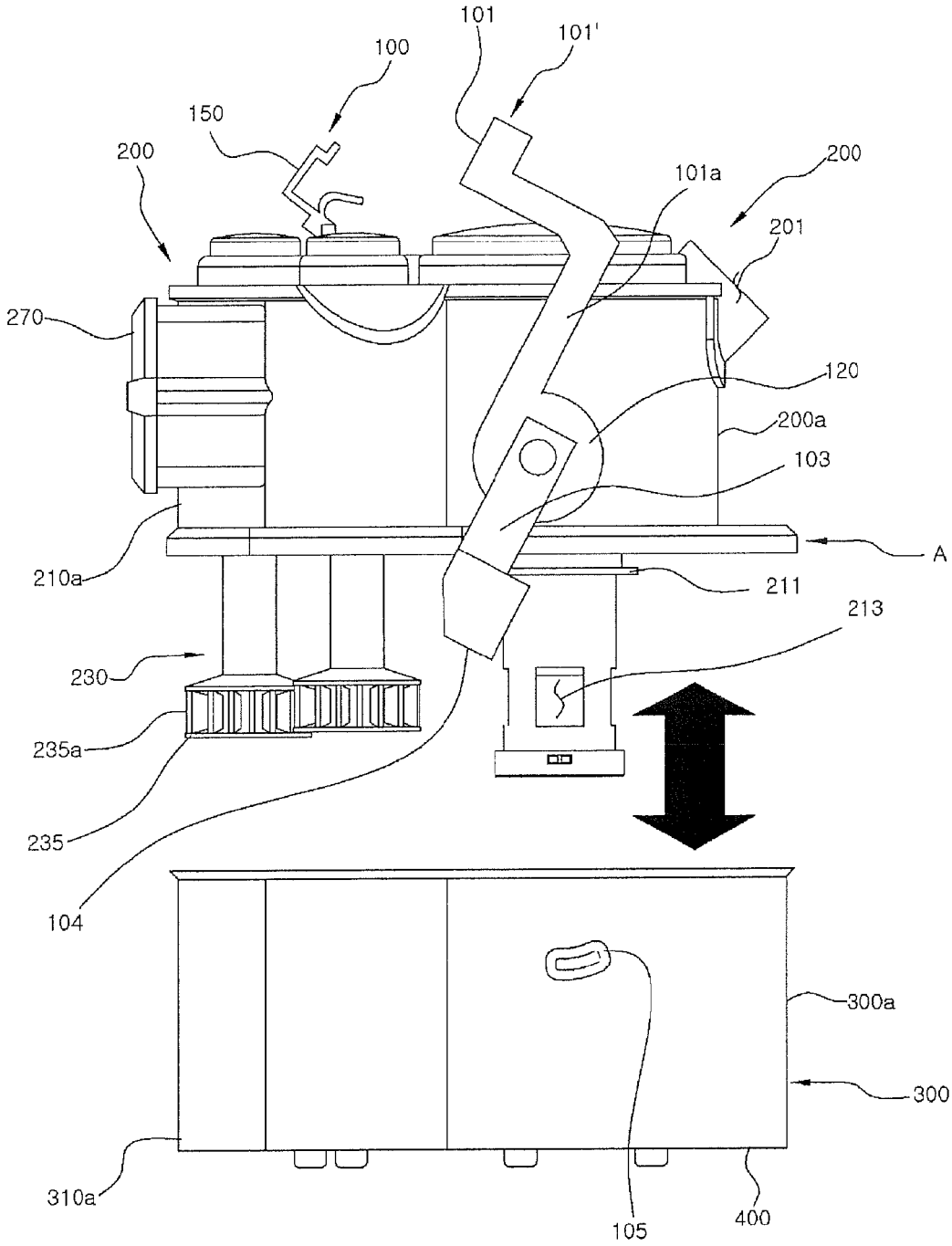
FIG. 7 is a perspective view illustrating a state in which a centrifugal separation assembly 200 and a dust box unit 300 of FIG. 1 are separated from each other.

FIG. 7 is a perspective view illustrating a state in which the centrifugal separation assembly 200 and the dust box unit 300 of FIG. 1 are separated from each other. Now, a coupling relationship between the centrifugal separation assembly 200 and the dust box unit 300 will be described with reference to FIGS. 2 to 7.

The centrifugal separation assembly 200 having the above described configuration, as illustrated in FIG. 7, is configured so as to be coupled to or separated from the top of the dust box unit 300. When the centrifugal separation assembly 200 is coupled to the dust box unit 300, the dust collector 1 of FIG. 1 is completed.

In this case, when the centrifugal separation assembly 200 is coupled to the dust box unit 300, the first centrifugal separating tube 200*a* and the first dust box 300*a* are coupled to each other and define a first separation structure A.

Each of the second centrifugal separating tubes 210*a* and each of the second dust boxes 310*a* define a second centrifugal separation structure B'. Each second centrifugal separation structure B' serves to separate fine dust which has not been separated in the first separation structure A. A combination of a plurality of second centrifugal separation structures B' defines a second separation structure B in which impurities, such as fine dust and the like, which have not been separated in the first separation structure A, is separated.

As described above, after the centrifugal separation assembly 200 is coupled to the dust box unit 300, the handle unit 100 is rotated counterclockwise to a position to keep the centrifugal separation assembly 200 and the dust box unit 300 coupled to each other. With rotation of the handle unit 100, as the fixing piece 104 and the latch piece 105 are coupled to each other, the centrifugal separation assembly 200 and the dust box unit 300 may be fixed to each other without a risk of separation. In such a state, when the grip piece fixing member 150*a* of the holder 150 is fitted to the grip piece 101, the handle 101' is locked so as not to be rotated. In addition, as the elastic rib support piece 152 applies pressure to the elastic rib 151, both ends of the elastic rib 151 defining an opening are brought into close contact with each other, thereby accumulating elastic restoration force.

When the dust collector 1, which is assembled as described above, is mounted in the vacuum cleaner (not shown), the exhaust chamber 270 is connected to a channel that communicates with the fan motor unit (not shown) of the vacuum cleaner (not shown). In addition, the first inlet 201 is connected to an inlet channel (not shown) that is connected to the brush assembly (not shown). With this configuration, the dust collector 1 defines a channel for the flow of air within the vacuum cleaner (not shown).

Thereafter, when the vacuum cleaner begins to operate, the outside air is introduced through the first inlet 201 and thereafter, impurities, such as dust and the like, contained in the air are separated in the first centrifugal separating area 200*c* and the second centrifugal separating areas 210*c*. The separated impurities are collected in the first wet type dust collecting area 300*c* and the second wet type dust collecting area 310*c*.

The resulting air, from which the impurities have been separated in the first centrifugal separating area 200*c* and the second centrifugal separating areas 210*c*, is directed into the exhaust chamber 270, thereby being discharged to the fan motor unit (not shown) of the vacuum cleaner.

Thereafter, when it is desired to separate the centrifugal separation assembly 200 from the dust box unit 300 in order to discharge the water containing the collected impurities from the dust box unit 300 or to clean the dust box unit 300, the grip piece fixing member 150*a* is separated from the grip piece 101. In this case, the elastic rib 151, which has been compressed by the elastic rib support piece 152, is returned to an original shape thereof by the elastic restoration force accumulated therein, thereby causing the grip piece fixing member 150*a* to be rotated and released from the grip piece 101. In addition, the elastic rib 151 serves to keep the grip piece fixing member 150*a* released from the grip piece 101.

After coupling between the grip piece fixing member 150*a* and the grip piece 101 is released as described above, the user may rotate the grip piece 101 clockwise. In this case, as the fixing piece 104 is rotated clockwise and is released from the latch piece 105, the centrifugal separation assembly 200 may be separated from the dust box unit 300.

When a locking operation or a locking release operation is performed after the centrifugal separation assembly 200 is coupled to the dust box unit 300, as described above, the rotating coupling member 120 and the handle coupling member 130 may function to prevent excessive rotation of the handle 101' and to stop rotation of the handle 101' in a locked state or in a locking released state.

Although the dust collector 1 having the above described configuration and function has been described as being a wet type dust collector, the dust collector 1 may operate as a dry type dust collector when water W is not filled therein. In addition, in the case in which the dust collector 1 is a dry type dust collector, the second separation structure B may be omitted.

Industrial Applicability

The disclosure is applicable to cleaning appliances, such as cleaners for family use, for business use and for industrial use.

The invention claimed is:

1. A dust collector for a vacuum cleaner, the dust collector comprising:

a first separation structure including a first centrifugal separating tube which defines a first centrifugal separating area to separate dust contained in air introduced through a first inlet, a first dust box to collect the dust separated in the first centrifugal separating area and a first exhaust pipe unit to discharge the air to the outside of the first centrifugal separating tube and the first dust box; and a handle unit to keep the first centrifugal separating tube coupled to the first dust box, or to release coupling between the first centrifugal separating tube and the first dust box, wherein the handle unit includes:

a handle coupling member formed at the first centrifugal separating tube; and a handle including a rotating coupling member rotatably coupled to the handle coupling member, the handle serving to fix the first centrifugal separating tube coupled to the first dust box or release the fixed first centrifugal separating tube according to a rotating direction thereof.

2. The dust collector according to claim 1, wherein the handle further includes:

a fixing piece formed at a lower end thereof; and a latch piece formed at a lateral surface of the first dust box so as to be coupled to the fixing piece, thereby keeping the first centrifugal separating tube coupled to the first dust box.

3. The dust collector according to claim 1, wherein the rotating coupling member and the handle coupling member are configured to stop rotation of the handle at a position where the handle fixes the first centrifugal separating tube and the first dust box coupled to each other, or at a position where the handle releases the fixed first centrifugal separating tube and first dust box.

4. The dust collector according to claim 1, wherein the rotating coupling member includes first to third fixing protrusions spaced apart from one another along a circle having a predetermined radius from the center thereof so as to define a first fixing recess and a second fixing recess therebetween, wherein the handle coupling member includes a fixing protrusion guide groove formed on a circle having a radius, corresponding to that of the circle on which the first to third fixing protrusions are formed, from the center thereof and an elastic member seating recess indented inside an accurate inner edge of the fixing protrusion guide groove, an elastic member being inserted into the elastic member seating recess such that a fixing bump thereof protrudes into the fixing protrusion guide groove, and wherein the rotating coupling member and the handle coupling member are coupled to each other to allow the first to third fixing protrusions to be rotatably inserted into the fixing protrusion guide groove, and when the handle is rotated, the fixing bump is inserted into the first fixing recess or the second fixing recess so as to stop rotation of the handle.

5. The dust collector according to claim 4, wherein the rotating coupling member further includes a guide protrusion formed on the circle on which the first to third fixing protrusions are formed, and wherein the handle coupling member further includes a guide protrusion groove formed on the circle on which the fixing protrusion guide groove is formed, such that the guide protrusion is inserted to be rotatable within a predetermined angular range.

6. The dust collector according to claim 1, wherein the handle unit further includes a holder configured to be coupled to the handle when the handle is located at a position to fix the first centrifugal separating tube and the first dust box coupled to each other, thereby locking the handle so as not to be rotated.

7. The dust collector according to claim 6, wherein the holder includes:

a grip piece fixing member rotatably coupled to an upper surface of the first centrifugal separating tube, the grip piece fixing member being coupled to or separated from the handle to selectively prevent rotation of the handle; and an elastic rib to provide elastic force required to return the grip piece fixing member to an original position thereof when the grip piece fixing member is coupled to the handle.

8. The dust collector according to claim 7, wherein the holder further includes an elastic rib support piece protruding from the upper surface of the first centrifugal separating tube and configured to come into close contact with the elastic rib so as to accumulate the elastic force in the elastic rib.

9. A dust collector for a vacuum cleaner, the dust collector comprising:

a first separation structure including a first centrifugal separating tube which defines a first centrifugal separating area to separate dust contained in air introduced through a first inlet, a first dust box to collect the dust separated in the first centrifugal separating area and a first exhaust pipe unit to discharge the air to the outside of the first centrifugal separating tube and the first dust box; and a handle unit to keep the first centrifugal separating tube coupled to the first dust box, or to release coupling between the first centrifugal separating tube and the first dust box, wherein the dust collector is divided into a centrifugal separation assembly and a dust box unit, which are separably coupled to each other, wherein the centrifugal separation assembly includes the first centrifugal separating tube and at least one second centrifugal separating tube, which respectively define a first centrifugal separating area and a second centrifugal separating area and are integrally formed with each other so as to communicate with each other through a second flow path, the top of the first separation structure provided with the first exhaust pipe unit and a second inlet tube unit being respectively coupled to the centrifugal separation assembly, and wherein the dust box unit includes the first dust box and at least one second dust box, which respectively define a first wet type dust collecting area and a second wet type dust collecting area to collect dust separated in the first centrifugal separating area and the second centrifugal separating area using water and are integrally formed with each other, the second centrifugal separating tube and the second dust box defining a second centrifugal separation structure, and the dust box unit being coupled to bottoms of the first separation structure and the second centrifugal separation structure.

* * * * *